United States Patent [19]

Van der Burgt

[11] 4,456,546

[45] Jun. 26, 1984

[54] PROCESS AND REACTOR FOR THE PREPARATION OF SYNTHESIS GAS

[75] Inventor: Maarten J. Van der Burgt, The Hague, Netherlands

[73] Assignee: Shell Oil Company, Houston, Tex.

[21] Appl. No.: 519,354

[22] Filed: Aug. 1, 1983

Related U.S. Application Data

[63] Continuation of Ser. No. 277,358, Jun. 25, 1981, abandoned.

[30] Foreign Application Priority Data

Sep. 2, 1980 [NL] Netherlands ..... 8004971

[51] Int. Cl.[3] ..... C01B 3/02

[52] U.S. Cl. ..... 252/373; 48/DIG. 2; 48/DIG. 4; 48/206; 48/210

[58] Field of Search ..... 252/373; 48/DIG. 2, 48/DIG. 4, 206, 210

[56] References Cited

U.S. PATENT DOCUMENTS

| | | | |
|---|---|---|---|
| 3,703,275 | 3/1955 | Elliott et al. . | |
| 3,963,426 | 6/1976 | Hand . | |
| 3,998,606 | 12/1976 | Miyashita et al. | 48/71 |
| 4,120,410 | 10/1978 | Van der Burgt . | |
| 4,146,369 | 3/1979 | Flesch et al. . | |
| 4,177,042 | 12/1979 | Wood . | |
| 4,197,092 | 4/1980 | Bretz . | |
| 4,278,445 | 7/1981 | Stickler et al. . | |
| 4,278,446 | 7/1981 | Rosenberg . | |
| 4,312,638 | 1/1982 | Koump . | |

*Primary Examiner*—Howard T. Mars

[57] ABSTRACT

A process for gasifying solid carbonaceous matter, e.g., coal, by introducing an oxygen-containing gas axially into a reactor, and introducing the carbonaceous matter at a right angle to the reactor axis from a point within the reactor, preferably by means of a centrifugal pump.

6 Claims, 1 Drawing Figure

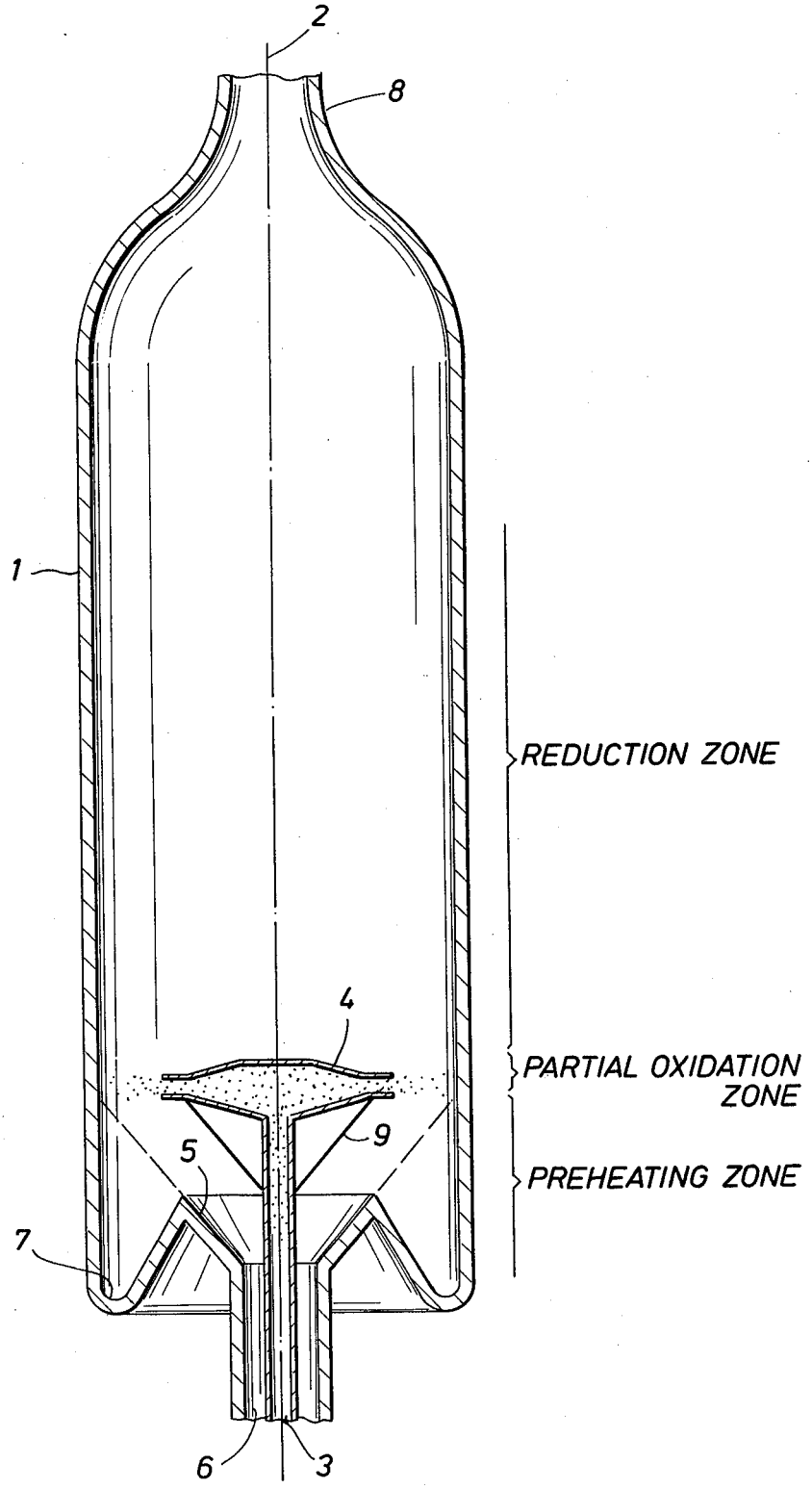
2
8
1
REDUCTION ZONE
4
PARTIAL OXIDATION ZONE
9
5
PREHEATING ZONE
7
6
3

PROCESS AND REACTOR FOR THE PREPARATION OF SYNTHESIS GAS

This is a continuation of application Ser. No. 277,358, filed June 25, 1981 abandoned.

BACKGROUND OF THE INVENTION

The application relates to a process for the preparation of synthesis gas by the partial combustion of a finely divided carbon-containing fuel with an oxygen-containing gas in a reactor. The application also relates to a reactor suitable for carrying out the process.

The synthesis gas thus prepared mainly consists of carbon monoxide and hydrogen and contains in addition, inter alia, minor quantities of carbon dioxide, water vapor and methane. If the partial combustion is not carried out with pure oxygen but with air, the product of course also contains much nitrogen.

By carbon-containing fuel is preferably meant coal and other solid fuels, such as brown coal, peat, lignite, waste wood, etc., but liquid fuels such as oil, optionally derived from tar sand, are also suitable.

The reactor is preferably mainly cylindrical, but oval or rectangular and similar reactors are also suitable.

Such a process and reactor are generally known. The finely divided carbon-containing fuel and the oxygen-containing gas have hitherto mostly been supplied together to the reactor by means of burners. The fuel and the oxygen are intermixed in or just upstream of the burner and interreact in the reactor.

The burners are very important parts of a gasification plant. An incorrect design or faulty setting of a burner causes poor mixing and combustion with, as a least serious effect, a lower yield of synthesis gas and/or increased soot formation. In a more serious effect, a flashback of the flame may occur in the burner or in the fuel feed line, or the flame may become too large and cause the reactor wall opposite the burner to become overheated. The solid, hard impurities in the fuel, such as sand grains, cause wear of the burners, owing to which the flame pattern and the gasification efficiency are adversely affected.

This critical role of the burners led to much research work involving many improvements in the details of their design. But, the above-mentioned problems are inherent in the concept of burners and may therefore always occur, although certain burners may tend to develop them rather earlier than others.

According to the present invention, the use of burners is avoided and consequently one is freed from such problems. This is preferably accomplished by supplying the oxygen-containing gas axially to one end of the reactor and feeding the fuel into the reactor downstream of the gas inlet at an angle of 90° (±20°) to the reactor axis from a centrifugal pump located inside the reactor.

SUMMARY OF THE INVENTION

The invention relates to a process for producing synthesis gas by partially combusting finely divided carbon-containing fuel with an oxygen-containing gas in a reactor. The oxygen-containing gas is flowed into one end of an elongated reactor and, downstream of the gas inlet, the fuel is fed into the reactor at an angle of 90° (±20°) to the reactor axis from a fuel input point located inside the reactor.

In addition, the invention relates to such a reactor with a substantially vertical axis, for the preparation of synthesis gas, in which there is an axial gas inlet near the bottom of the reactor ends and, at some distance above the gas inlet inside the reactor, a fuel inlet that is at an angle of 90° (±20°) to the reactor axis.

DESCRIPTION OF THE DRAWING

The drawing schematically illustrates a longitudinal section of the present reactor.

DESCRIPTION OF A PREFERRED EMBODIMENT

In the present reactor, the fuel is fed downstream of the gas inlet, rather than at the same point as the gas inlet. Thus, the present fuel supply system is distinctly different from one involving a burner. Since the present reactor is provided with separate supply lines for fuel and gas, the setting and repair or replacement of each separate line is facilitated. This improves flexibility and reduces cost of operating the reactor. The fuel feed line is the only item which is subject to the erosive effect of the fuel and consequently must periodically be replaced. The gas supply line can remain in the reactor. This is, of course, more economical than the replacement of complete burners.

In the present reactor, the fuel is preferably fed in a thin layer more or less orthogonal to the stream of oxygen-containing gas, which causes a regular and smooth gasification of the carbon-containing fuel while using the available reactor space as effectively as possible. In practice, fuel will advantageously be fed in such a manner that the whole cross-section of a generally annular gas stream is equally charged with fuel. Consequently, the reactor height or length can be relatively limited.

The present reactor is preferably vertically arranged, with the oxygen-containing gas being supplied at the bottom of the reactor and the synthesis gas being discharged at the top of the reactor. This embodiment requires a small surface area and is logically designed, since the synthesis gas spontaneously rises due to its low specific density.

In a preferred embodiment the carbon-containing fuel is fed in suspended form at the end of an axial feed line by one or more sprayers. It is possible to use a single sprayer with a circular spraying pattern at the top of the axial feed line or a number of holes or slots in the wall of said tube, near the top.

In another preferred embodiment, the carbon-containing fuel is fed by means of an ejector at the end of an axial feed tube. This may be effected, for example, by using an ejecting pump, in which a rotatable tubular elbow is caused to rotate by the velocity of the fuel particles being ejected. It is preferred, however, to use a centrifugal pump as ejector. In addition to feeding fuel particles, a centrifugal pump can also overcome a difference in pressure. It can force a mixture of fuel and inert gas having a relatively low pressure into a reactor containing gas at a higher pressure. Since most future gasification reactors will be operated at higher than atmospheric pressure, the use of a centrifugal pump for said two purposes also means a saving in the fuel supply compression apparatus required, such as lock systems. A pump of this type, which is especially suitable for feeding solid particles to a pressurized space, is described, for example, in the U.S. Pat. No. 4,120,410. On account of the rather high temperatures in the reactor when the pump of Patent 4,120,410 is used in the present invention, special provisions must be made in the field of drive motor location, insulation and bearings, which will not be further discussed here.

If the oxygen-containing gas is flowed into the bottom of a reactor below an inflow of the fuel, it contacts the descending hot fuel and/or slag particles. This yields two important additional advantages: (a) such contacts cause the oxygen to be preheated while the slag is being cooled; and (b) the last remainders of any carbon-containing fuel which is attached to slag particles is removed from the slag particles by combustion, which causes the unreacted portions of oxygen to be further heated. In reactor arrangements in which the slag is drained in liquid form, there is a tendency for the slag to cool off excessively and no longer flow, with the result that the discharge at the bottom is blocked. In the present system, in order to prevent this, it may be useful to further preheat the oxygen-containing gas and/or to locate the inlet(s) for the fuel at a higher level in the reactor.

Most partial combustion reactions in the present reactor take place at the level of the fuel inlet. But, some partially gasified fuel particles will be carried upward by the gas stream until they are fully gasified. At the higher levels in the reactor the rate of the exothermic reaction with oxygen becomes much slower due to the high concentration of synthesis gas and low concentration of oxygen. At those levels the predominant reaction is the endothermic reduction reaction between water and $CO_2$ to form CO and $H_2$.

Consequently, three zones can now be distinguished in the present reactor, from bottom to top: the preheating zone, the exothermic partial oxidation zone and the endothermic reduction zone.

The fuel particles are preferably introduced into the reactor at a speed high enough so that they do not fall at once but low enough so that they do not hit the adjacent side wall. In the ideal case, the upward pressure of the upflowing oxygen-containing gas balances the downward-acting gravity, so that the fuel particles remain at the same height in the reactor until they have fully reacted with the oxygen. However, this is not feasible in practice. The fuel particles disintegrate during the partial combustion and the smaller particles are more readily entrained and transported by the oxygen-containing gas. The upflowing smaller particles then react further within the endothermic zone. The larger and heavier particles tend to descend against the gas stream. They thus move into a zone with more oxygen, where they react more rapidly, until they disintegrate into smaller particles which are carried upward by the gas stream.

The non-combustible remainders, such as the silicate ash particles, are melted by the high temperature and tend to agglomerate. The heaviest ash particles descend, exchange heat with the stream of oxygen-containing gas and fall to the bottom of the reactor where they form the molten slag and ash. The lighter ash particles leave the reactor with the synthesis gas, as fly ash. With the aid of known means it is possible to cool and remove the slag and ash from the reactor and the synthesis gas discharge respectively. The molten slag is preferably collected in an annular channel in the bottom of the reactor and discharged therefrom.

The oxygen-containing gas is preferably injected into the reactor through a volume-expanding diffuser-shaped orifice. This results in better utilization of the reactor space by the oxygen-containing gas and decreases the gas velocity. At a certain height within the reactor the gas velocity becomes so low that the injected fuel is preferably fed at about this height, so that a kind of shield is formed between the partial oxidation zone and the endothermic reduction zone. The diffuser shape is preferably not extended above that height. Consequently, the reactor diameter can be determined as a function of the oxygen supply rate and temperature. In other words, at this height the bottom of the reactor becomes, in effect, like a side wall.

The fuel is preferably fed into the reactor at the height of the place where the oxygen-containing gas is substantially homogeneously distributed over the cross-section of the reactor. This means that the point of the fuel feed is located at a height or downstream distance from the point of gas supply at which a plane normal to the reactor axis (along which plane the fuel is introduced) intersects the reactor wall at about the same height as an extension of the diffuser-shaped plane along which the gas is introduced.

In the process according to the invention the reaction temperature is approximately 1600° C., preferably between 1300° and 1900° C. The feed of carbon-containing fuel is about 0.1–0.9 kg/s/m$^3$ of reactor space. The oxygen-containing gas is supplied to the reactor in such quantities that the oxygen-carbon weight ratio lies between 0.6 and 0.8. The pressure is preferably between 3 and 60 atm., in particular between 15 and 45 atm.

The drawing represents a diagrammatic longitudinal section of a reactor according to the invention. Cooling means, insulation, valves, thermometers etc., are not shown in the drawing.

The illustrated reactor is defined by a vertical cylindrical wall 1 that is built up of a number of cooling tubes through which steam can flow at high pressure. The longitudinal axis of the reactor is indicated by the line 2. The carbon-containing fuel is fed by means of a centrifugal pump having an axial inlet 3 and a rotor 4 fixedly connected thereto that is hollow and provided with a narrow outlet slit on the edge. Coal particles supplied by the tube 3 are centrifugally accelerated in the rotor 4 so that they are capable of overcoming and flowing into the pressure prevailing in the reactor.

The slope of the diffuser-shaped orifice 5 of the gas supply line 6 is so chosen that the extension of said orifice (i.e., shown by broken line) intersects the reactor wall at about the height of the hollow rotor 4. Further, the upper portion of the axial supply line 3 is provided with a conical deflecting plate 9 to assist in directing the oxygen stream along the direction of the orifice 5.

The internal arrangement is preferably such that, within the reactor, the molten slag falls directly or drips into the annular channel 7 along a bottom portion of the wall of 1. From that channel the slag is passed into a water bath via a slag discharge valve means (not shown).

The synthesis gas which is formed leaves the reactor through the discharge 8, whereupon it is cooled and purified.

HYPOTHETICAL EXAMPLE

A quantity of 30,000 kg/h of finely ground coal dust and 1500 kg of nitrogen at 40° C. as carrier gas is injected via the pump 4 into a reactor having the above-mentioned shape and an internal volume of 12 m$^3$. That coal dust may have an average particle size of 50$\mu$ and the following composition on a dry and ashless basis:

C—78.1% by weight,
H—5.5% by weight,
N—1.2% by weight,
O—10.9% by weight,
S—4.3% by weight.

The ash content may be '12.6% by weight and the moisture content may be 2% by weight.

Where the reactor has a pressure of 40 atm, a quantity of 25,000 kg/h of gas at 200° C. and of the following composition may be introduced through the supply line:

$O_2$—99% by volume,
$N_2$—0.3% by volume,
Ar—0.7% by volume.

A quantity of 1000 kg of moderator steam should be added to this gas.

A quantity of 54,000 kg/h of synthesis gas at 1500° C. and the following composition may be removed through the outlet or discharge 8:

CO—63.5% by volume,
$H_2$—31.8% by volume,
$CO_2$—0.8% by volume,
$H_2S$—1.3% by volume,
$H_2O$—1.5% by volume,
COS—0.1% by volume,
$CH_4$—-% by volume,
$N_2$—0.8% by volume,
Ar—0.2% by volume.

The synthesis gas formed may be practically free from soot and may contain 3% by weight of fly ash, which can be removed in a cyclone.

The remaining coal dust solids can be discharged as molten slag collected in the annular channel 7 and dropped into a water bath to be cooled. Such a cooled slag-water mixture should be drained via a lock system so that the high pressure in the reactor is maintained.

What is claimed is:

1. A process for the preparation of synthesis gas by partially combusting finely divided carbon-containing fuel with oxygen-containing gas in a generally elongated vertical reactor, comprising:

inflowing the oxygen-containing gas into the reactor adjacent the bottom along the vertical axis of said reactor;

feeding the fuel to the reactor from a point located inside the reactor on the vertical axis of said reactor, and downstream of the point of the gas inflow, said fuel entering the reactor along a direction at an angle of 90° (±20°) to the reactor vertical axis;

maintaining sufficient gas flow to suspend the fuel in inflowing gas while partially combusting said fuel, and removing the synthesis gas from the top of the reactor.

2. The process of claim 1 or 2, in which the carbon-containing fuel is fed in suspended form by one or more sprayers at the end of an axial feed line.

3. The process of claim 1 or 2, in which the carbon-containing fuel is fed by means of an ejector device at the end of an axial feed line.

4. The process of claim 4, in which said ejector device is a centrifugal pump.

5. The process of claim 1 or 2 in which the oxygen-containing gas is inflowed through a diffuser-shaped orifice.

6. The process of claim 6, in which the fuel is fed at the height of the point where the oxygen-containing gas is substantially homogeneously distributed over the cross-section of the reactor.

* * * * *